US010421588B2

(12) United States Patent
Middleton et al.

(10) Patent No.: US 10,421,588 B2
(45) Date of Patent: Sep. 24, 2019

(54) MEMBRANE SEALED CONTAINER

(71) Applicant: ABBOTT LABORATORIES, Abbott Park, IL (US)

(72) Inventors: Jason Middleton, Dublin, OH (US); Spencer Beaufore, Dublin, OH (US); Jeremy McBroom, Columbus, OH (US)

(73) Assignee: ABBOTT LABORATORIES, Abbott Park, IL (US)

( * ) Notice: Subject to any disclaimer, the term of this patent is extended or adjusted under 35 U.S.C. 154(b) by 100 days.

(21) Appl. No.: 15/562,126

(22) PCT Filed: Mar. 28, 2016

(86) PCT No.: PCT/US2016/024529
§ 371 (c)(1),
(2) Date: Sep. 27, 2017

(87) PCT Pub. No.: WO2016/160709
PCT Pub. Date: Oct. 6, 2016

(65) Prior Publication Data

US 2018/0079566 A1 Mar. 22, 2018

Related U.S. Application Data

(60) Provisional application No. 62/139,581, filed on Mar. 27, 2015.

(51) Int. Cl.
*B65D 51/16* (2006.01)
*B65D 77/20* (2006.01)
(Continued)

(52) U.S. Cl.
CPC ..... *B65D 51/1611* (2013.01); *B65D 51/20* (2013.01); *B65D 77/2024* (2013.01);
(Continued)

(58) Field of Classification Search
CPC ..... B65D 51/00–1611; B65D 77/00–2024; B65D 77/225; B65D 51/20;
(Continued)

(56) References Cited

U.S. PATENT DOCUMENTS 4,324,601 A * 4/1982 Dembicki ..... B29C 65/3656 156/69
5,688,544 A * 11/1997 Bolton ..... B65D 17/502 426/118
(Continued)

OTHER PUBLICATIONS

International Search Report from Application No. PCT/US2016/024529 dated Jun. 17, 2016.

*Primary Examiner* — Kareen K Thomas
(74) *Attorney, Agent, or Firm* — Calfee, Halter & Griswold LLP

(57) ABSTRACT

A sealed container for packaging of granular or powdered product including a rigid container body defining an interior space and an upper portion, the upper portion having a sealing lip that defines an opening to the interior space, and a flexible, polymer sealing membrane removably attached to the sealing lip to cover the opening, the sealing membrane including a plurality of laser generated micro-perforations formed through the sealing membrane, the size of each of the plurality of laser generated micro-perforations being less than 3.937 mils.

19 Claims, 8 Drawing Sheets

(51) Int. Cl.
*B65D 77/22* (2006.01)
*B65D 51/20* (2006.01)

(52) U.S. Cl.
CPC ..... *B65D 77/225* (2013.01); *B65D 2205/02* (2013.01); *B65D 2251/0018* (2013.01); *B65D 2251/0093* (2013.01)

(58) Field of Classification Search
CPC ..... B65D 2251/00–0093; B65D 2251/0018; B65D 2205/02
See application file for complete search history.

(56) References Cited

U.S. PATENT DOCUMENTS

| | | | | |
|---|---|---|---|---|
| 6,182,850 | B1 * | 2/2001 | Marbler | B65D 77/225 220/359.3 |
| 8,038,023 | B2 * | 10/2011 | Moore | B65D 77/225 220/745 |
| 8,308,008 | B2 * | 11/2012 | Perry | B65D 43/169 206/508 |
| 8,469,223 | B2 * | 6/2013 | Perry | B65D 1/42 220/212 |
| 8,511,499 | B2 * | 8/2013 | Perry | B65D 51/24 220/254.3 |
| 9,387,962 | B2 * | 7/2016 | Mercado | B65D 43/22 |
| 9,387,963 | B2 * | 7/2016 | McBroom | B65D 43/169 |
| 9,428,297 | B2 * | 8/2016 | Lewis | B65D 1/22 |
| 2009/0155435 | A1 | 6/2009 | Loaiza et al. | |
| 2009/0266818 | A1 | 10/2009 | Savageau | |
| 2010/0151166 | A1 | 6/2010 | Almenar et al. | |
| 2014/0227100 | A1 | 8/2014 | Farooqui | |

* cited by examiner

MEMBRANE SEALED CONTAINER

RELATED APPLICATION

This application is the U.S. national stage entry of PCT/US2016/024529, with an international filing date of Mar. 28, 2016 and claims priority to and any benefit of U.S. Provisional Application No. 62/139,581, filed Mar. 27, 2015, the disclosures of which are hereby incorporated by reference in their entirety.

TECHNICAL

The present disclosure relates generally to sealed containers for granular or powdered products. More particularly, the present disclosure relates to a method and seal for the venting a sealed container.

BACKGROUND

Many consumer products are packaged in granular or powdered form, such as for example, nutritional products, infant formula, flour, coffee, and sugar. Granular or powdered products which are sold in volumes larger than one-time use amounts require specific packaging. The packaging must be suitable for transportation and storage until first-time use by a consumer and must subsequently provide adequate storage for the consumer between uses. Adequately storing the product throughout the consumption period of the volume of powder requires packaging which prohibits waste and contamination, is strong and durable, and is convenient to the user.

Large volume consumer powdered products have been conventionally offered in a paper cylindrical package with a plastic peel-off lid. Powdered manufacturers have recently looked to new and innovative containers for many reasons, including durability, contamination, manufacturing waste, and consumer waste. The container must also be suitable for long-distance trailer and cargo container shipping. For example, the container must be acceptable for packaging, shipment and storage at a variety of elevations.

Packaged products will encounter air pressure differentials associated with elevation gains and losses as they are distributed. When containers are sealed, the containers trap the surrounding environment inside the container. For example, a container sealed near sea level will have an air pressure that is greater than the air pressure at higher elevations. When that container is distributed to a high elevation location, the greater air pressure in the interior of the container will applies interior force to the container. Depending on the container design, contents, headspace volume, etc., this pressure differential may negatively affect the container by deforming its shape or causing seal integrity issues. The opposite reaction happens when a container is sealed in a high elevation location because lower air pressure is trapped inside the container. When that container is distributed to a near sea level location, the greater air pressure in the outside environment applies exterior force to the container. This pressure differential may negatively affect a plastic container appearance, such as for example, by causing paneling. For example, a plastic walled container may bow in or bow out to a noticeable amount.

SUMMARY

The present application discloses a method and a sealing membrane for venting a sealed container for packaging of granular or powdered product. In one exemplary embodiment, the sealed container includes a rigid container body defining an interior space and an upper portion, the upper portion having a sealing lip that defines an opening to the interior space, and a flexible polymer sealing membrane removably attached to the sealing lip to cover the opening, the sealing membrane including a plurality of laser generated micro-perforations formed through the sealing membrane, the size of each of the plurality of laser generated micro-perforations being less than 3.937 mils.

BRIEF DESCRIPTION OF THE DRAWINGS

Features and advantages of the general inventive concepts will become apparent from the following detailed description made with reference to the accompanying drawings.

DETAILED DESCRIPTION

Figure 1:
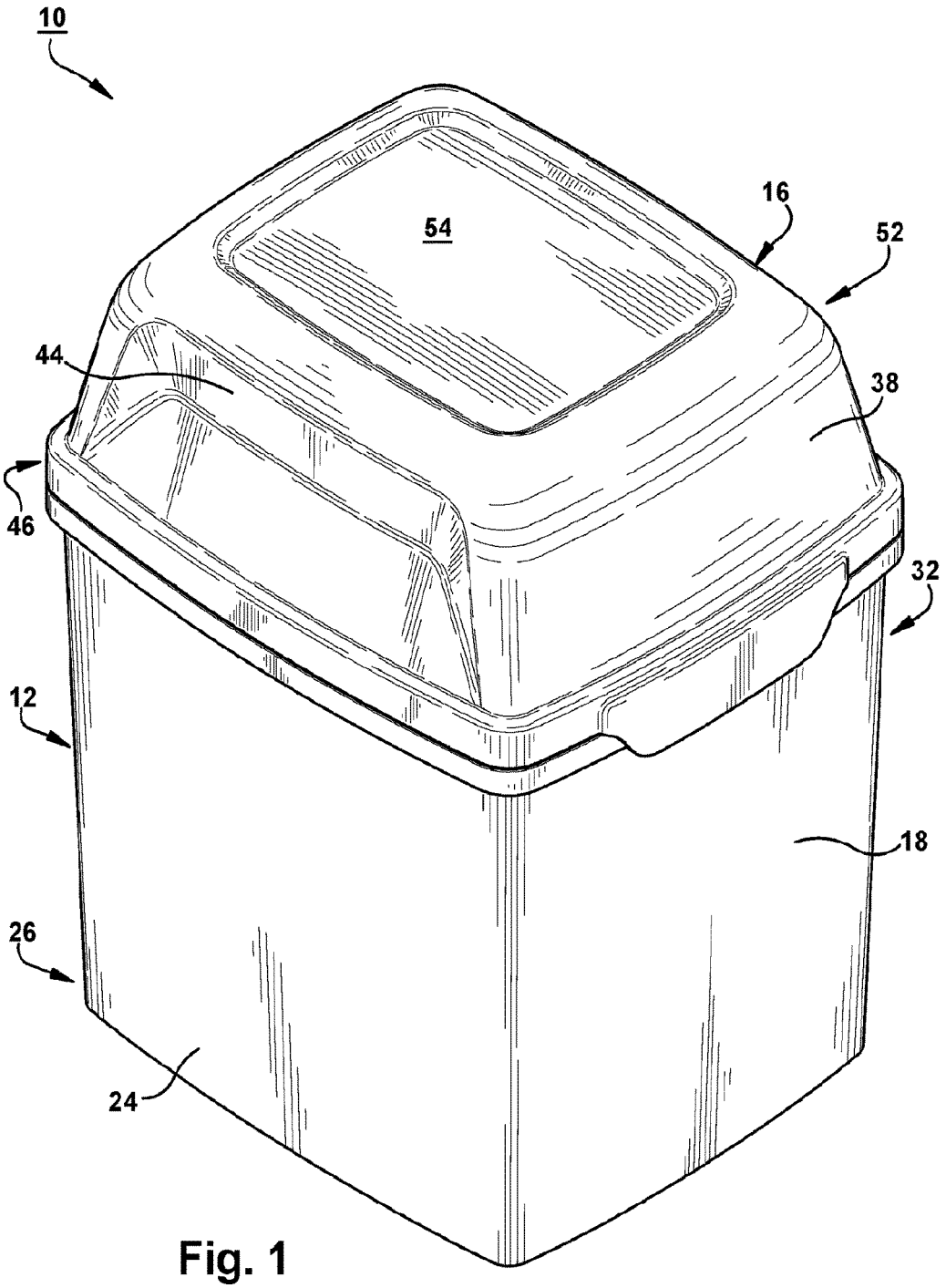
FIG. 1 is a top, perspective view of an exemplary embodiment of a container.

The present disclosure describes a method and sealing membrane for venting a sealed container. Referring now to the drawings, a container 10 for holding a granular or powdered product is shown in FIGS. 1-4. The container 10 includes a body or receptacle 12, a sealing membrane 14, and a lid 16. The container 10 may be configured in a variety of ways. For example, the container 10 may be any suitable shape or size and may be made from any suitable material. In one exemplary embodiment, the container 10 may be suitable for packaging of the granular or powdered product at a manufacturing facility to be sold in volumes larger than one-time use amounts. In one exemplary embodiment, the container 10 may be suitable for use in packaging infant powder formula which is sold in multiple-use amounts. In another exemplary embodiment, the container 10 may be used for powder products that do not require an oxygen barrier, such as for example, EAS Performance Nutrition powder products. It should be understood, however, that the container 10 may be used with any type of granular or powdered product, such as for example, flour, coffee, sugar, nutritional powders, such as whey-based nutritional powders, and any packaged volume of granular or powdered product.

In the illustrated exemplary embodiment, the body or receptacle 12 is generally rigid and generally the shape of a cuboid. In other embodiments, however, the body 12 may be shaped other than cuboid, such as for example, a cylinder or any other suitable shape. The body 12 includes a plurality of side walls including a first side wall 18, a second side wall 20 (FIGS. 3 and 4) spaced apart from and generally parallel to the first side wall 18, a third side wall 22 (FIGS. 2 and 3) generally perpendicular to and extending between the first and second side walls 18, 20, and a fourth side wall 24 (FIG. 1) spaced apart from and generally parallel to the third side wall 22 and generally perpendicular to and extending between the first and second side walls 18, 20.

Figure 3:
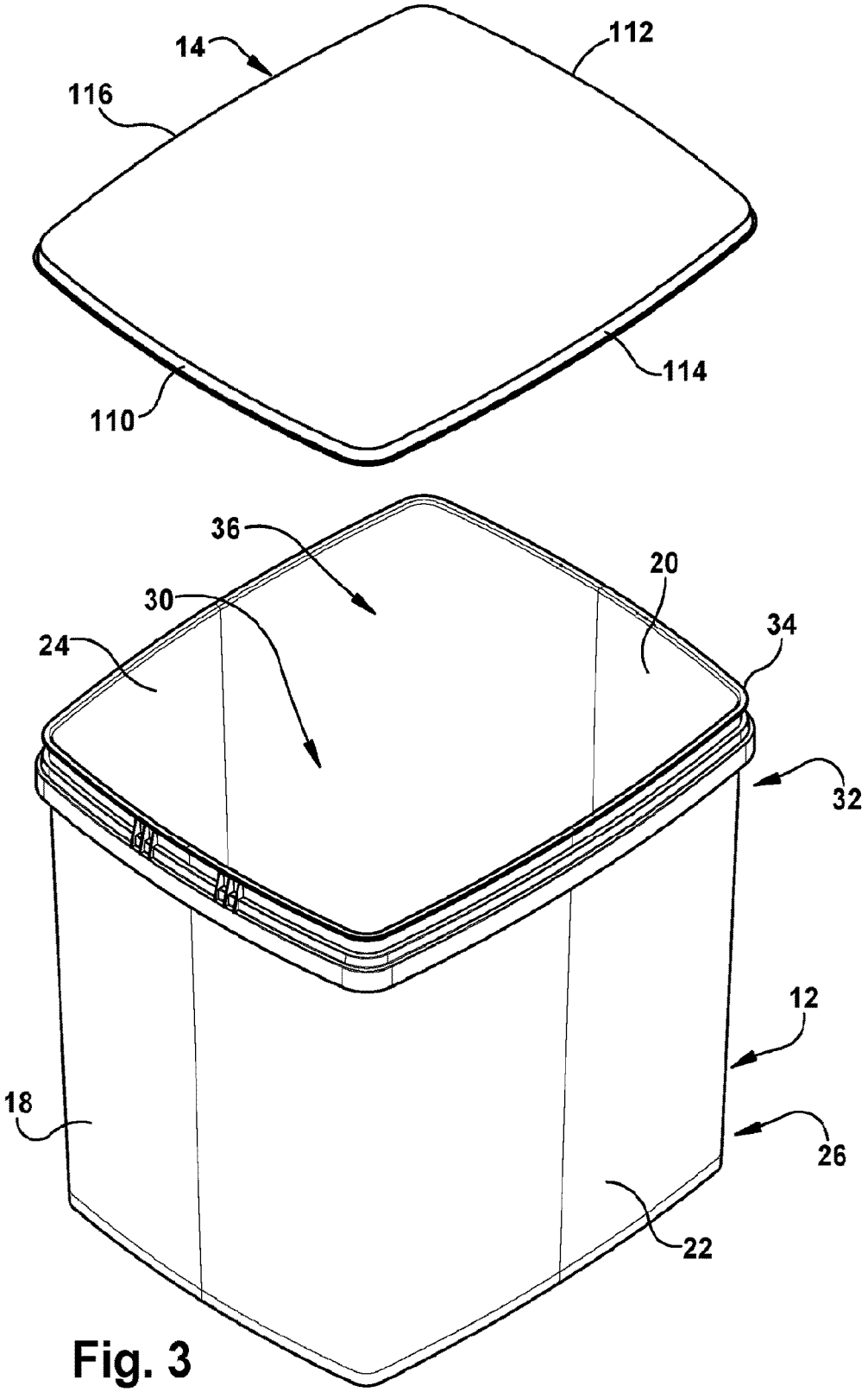
FIG. 3 is a perspective, assembly view of the container of FIG. 1, showing only a container body and the sealing membrane.
Figure 4:
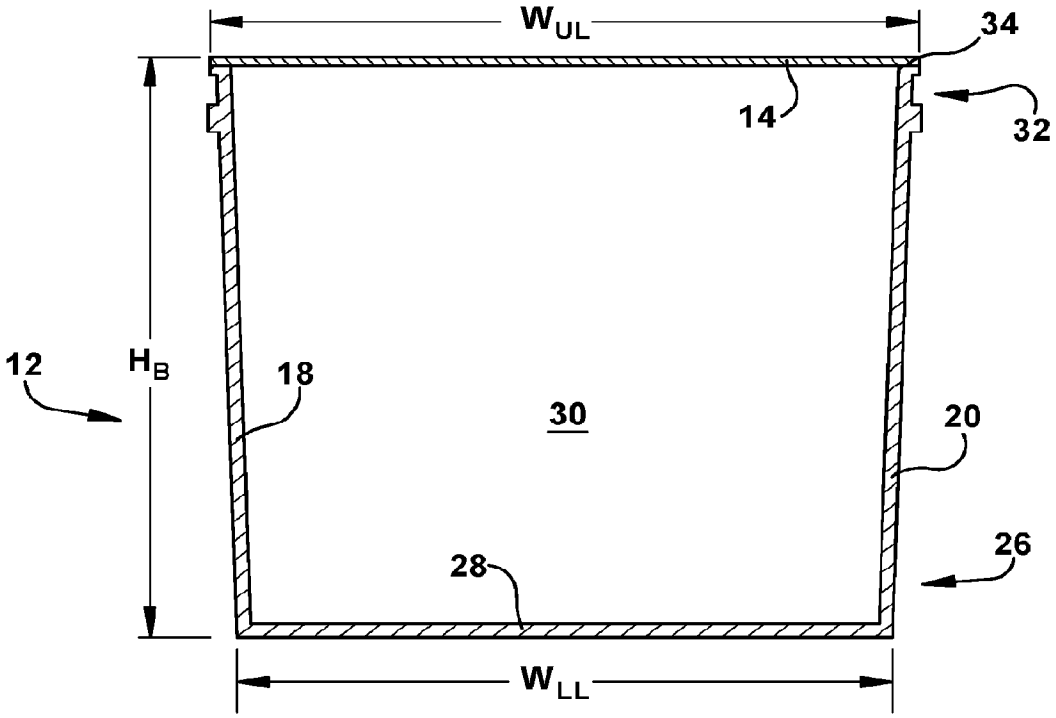
FIG. 4 is a side section view of the container body with the seal membrane applied over the container opening.

The body 12 includes a lower portion 26 closed by a bottom wall 28 (FIG. 4). The bottom wall 28 and the plurality of sidewalls 18, 20, 22, 24 define an interior space 30 for a storing granulated or powder product. The body 12 includes an upper portion 32 having a sealing lip 34 defining an opening 36 to the interior space 30 (FIG. 3).

Figure 2:
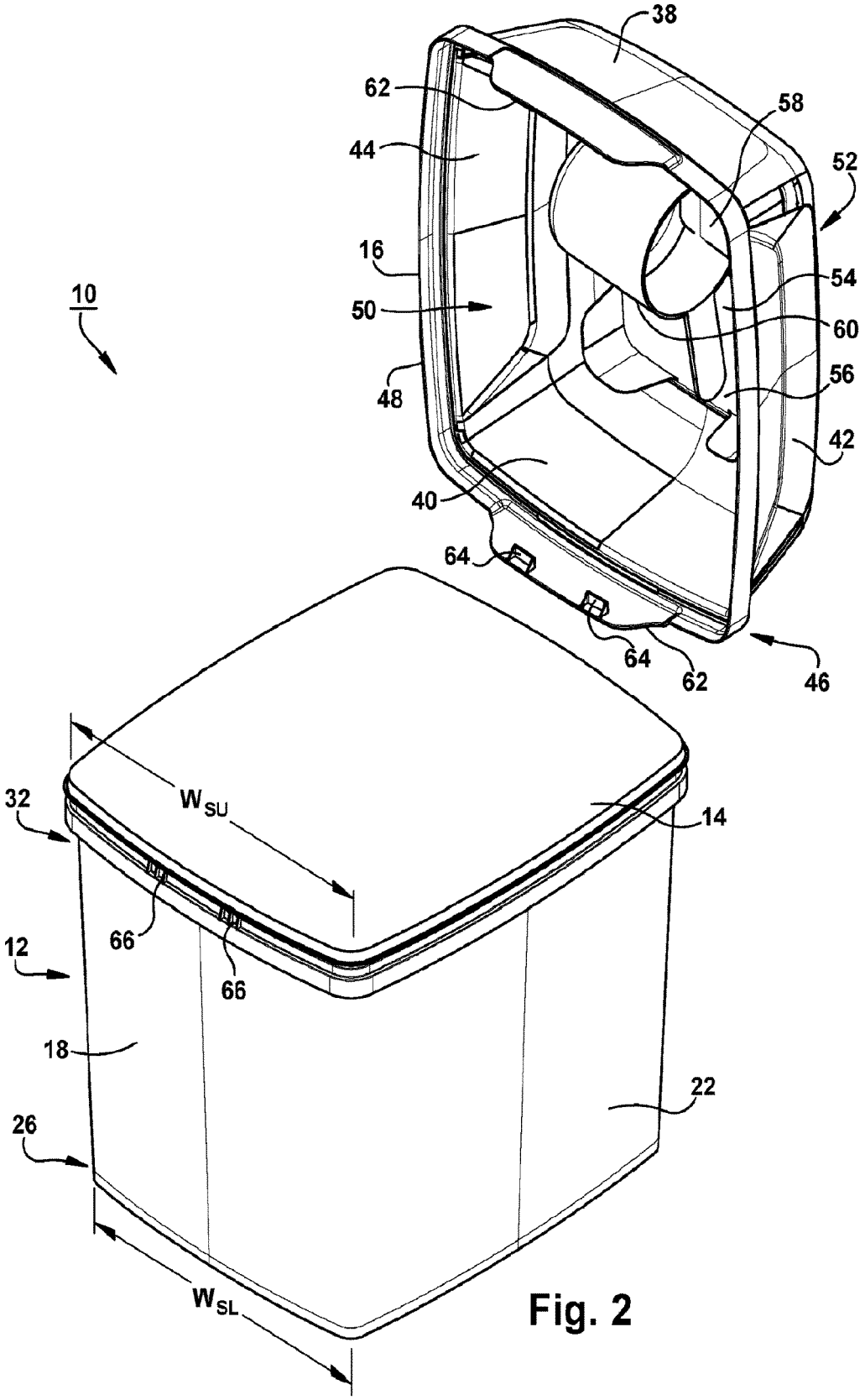
FIG. 2 is a perspective view of the container of FIG. 1, showing a lid in an open and detached position and a sealing membrane over an opening of the container.

Referring to FIGS. 2 and 4, in the illustrated embodiment, the first and second side walls 18, 20 have a smaller width than the third and fourth side walls 22, 24. In one exemplary embodiment, the container body 12 has a height $H_B$, a short lower body width $W_{SL}$, a long lower body width $W_{LL}$, a short upper body width $W_{SU}$, and a long upper body width $W_{LU}$. In one exemplary embodiment (Y), the body height $H_B$ is about 6.0 inches, the short lower body width $W_{SL}$ is about 5.34 inches, a long lower body width $W_{LL}$ is about 6.27 inches, a short upper body width $W_{SU}$ is about 5.91 inches, and a long upper body width $W_{LU}$ is about 6.83 inches.

The body 12 and lid the 16 are cooperatively arranged such that a user may manipulate the lid 16 between a closed position and an open position to access the interior space 30 of the container 10. The lid 16 may be configured in a variety of ways. Any configuration capable of moving between an open position to provide access to the interior space 30 and a closed position to cover the interior space 30 may be used.

Referring to FIG. 2, in the illustrated embodiment, the lid 16 includes a plurality of side walls including a first side wall 38, a second side wall 40 spaced apart from and opposite the first side wall 38, a third side wall 42 generally perpendicular to and extending between the first and second side walls 38, 40, and a fourth side wall 44 spaced apart from and opposite the third side wall 42 and generally perpendicular to and extending between the first and second side walls 38, 40.

The lid 16 includes a lower portion 46 having a lower edge 48 defining an opening 50. The lid 16 includes an upper portion 52 closed by a top wall 54 having an inner surface 56. In the illustrated embodiment, the inner surface 56 may include retention structure 58 for holding a scoop 60 used to dispense a measured amount of the granular or powdered product from the container 10.

In the illustrated embodiment, the lid 16 may be manually attached to and detached from the body 12 by a user. The lid 16 and body 12 may include cooperating attachment portions to facilitate the lid 16 being attachable and detachable from the body 12. Any suitable attachment portions may be used. For example, the lid 16 may be a non-threaded closure, such as for example, a snap-on and snap-off closure. In the illustrated embodiment, the lid 16 includes one or more tabs 62 extending downward from the lower edge 48. Each tab 62 may include one or more projections 64 to engage one or more grooves or recesses 66 on the upper portion 32 of the container 12 to retain the lid 16 onto the container. The tabs 62 may be flexed outward to disengage the one or more projections 64 from the one or more grooves or recesses 66 to remove the lid 16 from the container 12. In other embodiments, however, the lid 16 may attach to the body 12 by a threaded connection, by a hinged connection, such as a mechanical hinge or living hinge, or by any other suitable configuration.

The container body 12 and the lid 16 may be constructed by various methods. The exemplary container 10 may be stackable and may be manufactured by an injection molding process, or other suitable method. In one exemplary embodiment, the body 12 and the lid 16 are each injection molded in separate molds. In other embodiments, however, the body 12 and the lid 16 may be formed integrally, such as being connected by a living hinge. The container body 12 and the lid 16 may be formed from a direct food contact approved polymer, such as for example, polyethylene or polypropylene. In one manufacturing technique, the container body 12 and the lid 16 are shipped in separate stacks from the molder to a powder manufacturer and final filling facility. It will be understood by those skilled in the art that the invention may be practiced by other manufacturing methods and by using other production materials.

The sealing membrane 14 of the container 10 is arranged to cover the opening 36 to the interior space 30 and form a seal against the sealing lip 34 to protect the contents of the container 10 after packaging, during shipment, and during storage prior to sale. The sealing membrane 14 may also help to preserve freshness or indicate tampering. The sealing membrane 14 may be configured in a variety of ways. For example, the sealing membrane 14 may be made of any suitable seal material, such as for example, a material suitable to protect the contents from moisture, oxygen and light. In some embodiments, the sealing membrane 14 may include a substantially moisture-impervious, oxygen-impervious material, such as for example, aluminum foil, or a foil made of some other metallic material, or a combination of materials and layers that can include a metallic, a polymeric, and other material layers. In one exemplary embodiment, the sealing membrane 14 is a film lamination through the use of adhesive layers and/or polyethylene extrusion layers. The layers that form the lamination may be made of, but not limited to, polyethylene terephthalate films, polyethylene films, polypropylene films, metalized films, aluminum foil and/or paper substrates.

In the exemplary embodiment, the sealing membrane 14 is a multilayered, flexible, polymer membrane. In the illustrated embodiment, the sealing membrane 14 includes five layers. In other embodiments, however, the sealing membrane 14 may include more or less than five layers.

Figure 6:
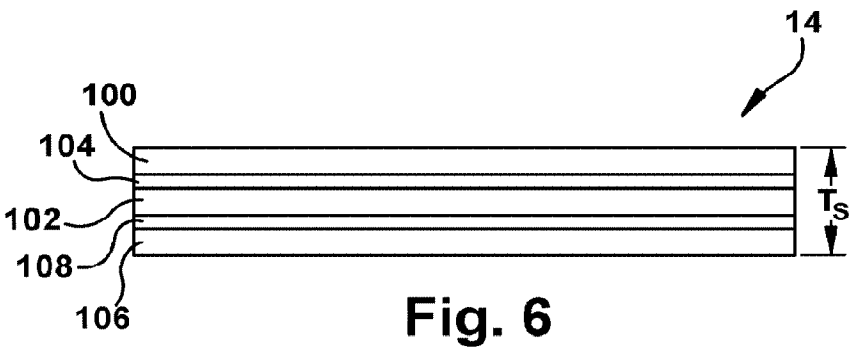
FIG. 6 is a side section of the multi-layered sealing membrane of FIG. 6.
Figure 5:
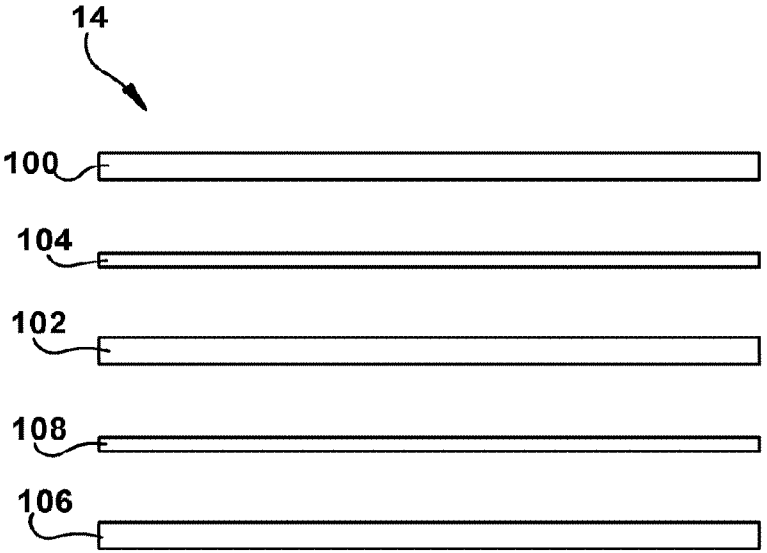
FIG. 5 is a side section, assembly view of exemplary embodiment of a multi-layered sealing membrane.

Referring to FIGS. 5 and 6, the exemplary sealing member 14 includes an outer layer 100 attached to an intermediate layer 102 by a first adhesive layer 104. The outer layer 100 comprises a polymer selected from a group of, but not limited to, polyethylene terephthalate film, polyethylene film, and polypropylene film. The intermediate layer 102 comprises any suitable metalized film or metallic foil, such as, but not limited to, a metalized polyester or equivalent or aluminum foil or other metallic layer. The first adhesive layer 104 comprises any suitable adhesive, such as for example, a known or suitable adhesive used in the flexible packaging industry. The sealing member 14 includes an inner layer 106 attached to the intermediate layer 102 by a second adhesive layer 108. The inner layer 106 comprises a polymer selected from a group of, but not limited to, polyethylene terephthalate film, polyethylene film, and polypropylene film. The second adhesive layer 108 comprises any suitable adhesive, such as for example, a known or suitable adhesive used in the flexible packaging industry. In one exemplary embodiment, the outer layer 100 is made from the same material as the inner layer 106 and the first adhesive layer 104 is the same adhesive as the second adhesive layer 108. In other embodiments, however, the outer layer 100 and the inner layer 106 may include different polymers and the first adhesive layer 104 may include a different adhesive than the second adhesive layer 108.

Figure 7:
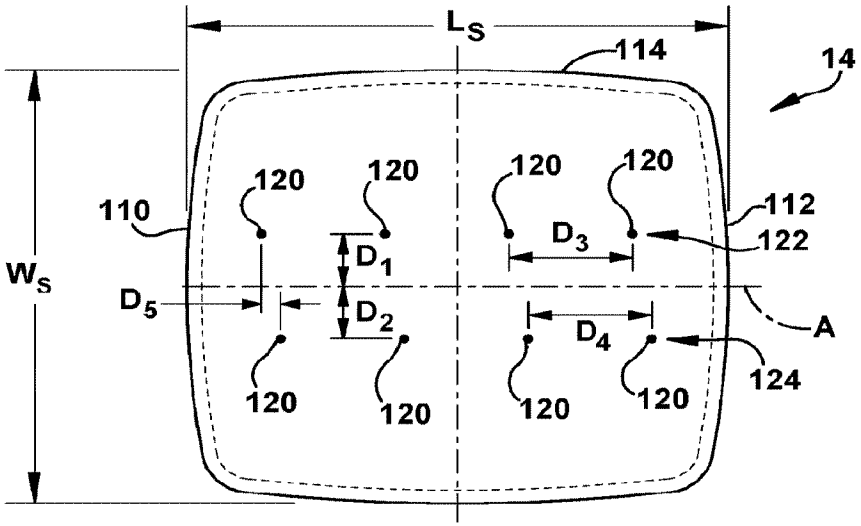
FIG. 7 is a top view of the sealing membrane of FIG. 5.

Referring to FIG. 7, the sealing membrane 14 has a first edge 110, a second edge 112 spaced apart from the first edge 110, a third edge 114 extending between the first and second edges 110, 112, and a fourth edge 116 spaced apart from the third edge 114 and extending between the first and second edges 110, 112.

The sealing membrane 14 has a thickness $T_S$ (FIG. 6), a length $L_S$ extending between the first and second edges 110, 112, and a width $W_S$ extending between the third and fourth edges 114, 116. The thickness $T_S$, the width $W_S$, and the length $L_S$ may vary in different embodiments. In one embodiment, the thickness $T_S$ is in the range of about 2 mils to about 5 mils. In one embodiment, the thickness $T_S$ is in the range of about 2.5 mils to about 3.5 mils.

The width $W_S$ and length $L_S$ of the sealing membrane 14 are sufficient to allow the sealing membrane 14 to seal onto the sealing lip 36 around the entire perimeter of the sealing lip. In one exemplary embodiment, the sealing membrane 14 has a width $W_S$ between about 6 inches and about 6.5 inches and a length $L_S$ between about 6.5 inches and about 7.25 inches. In one exemplary embodiment, the sealing membrane 14 has a width $W_S$ of about 6.25 inches and a length $L_S$ of about 7.2 inches. In one exemplary embodiment, the sealing membrane 14 has an area of less than 50 square inches, such as for example, in the range of about 43 square inches to about 47 square inches.

The sealing membrane 14 may be sealed onto the sealing lip 36 of the body 12 by any suitable sealing method, such as for example, conduction or induction heat sealing. The strength of the seal formed between the sealing lip 36 and the sealing membrane 14 is sufficient to retain integrity of the seal during normal handling and distribution of the container, but also allow the consumer to readily peel off the sealing membrane 14 to access the interior space 30.

The sealing membrane 14 includes a plurality of laser drilled, micro-perforations 120 extending through the thickness T of the sealing membrane 14. The laser perforations 120 are designed to reduce the pressure differential between the internal air pressure in the interior space 30 of the container 10 and the external air pressure on the container 10 by allowing air to transfer out of the container 10 through the laser perforations 120 when the container 10 experiences conditions of lower external air pressure and to allow air to transfer into interior space through the laser perforations 120 when the container 10 experiences conditions of greater external air pressure.

The shape, size, number, location, and pattern of the laser drilled, micro-perforations 120 are designed to keep the pressure differential between the internal air pressure and external air pressure below a seal strength threshold pressure $P_{ST}$, which is defined as the pressure differential at which the seal between the sealing membrane 14 and the sealing lip 36 will fail.

Figure 9:
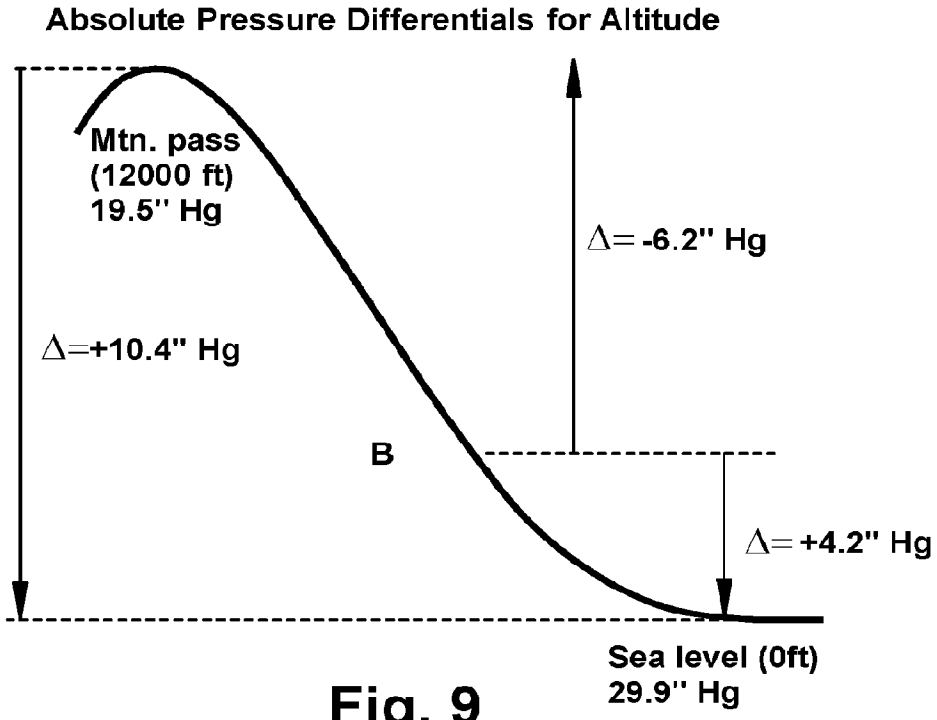
FIG. 9 is a graph of absolute pressure differentials for altitude.

FIG. 9 illustrates the Absolute Pressure Differential due to change in Altitude. As show in FIG. 9, the delta pressure between a point at 12000 ft above sea level and a point at sea level is approximately 10.4 inHg. A product packaged in a sealed container at a location B between those two points, would have an internal space sealed pressure consistent with the pressure at point B. The pressure at Point B, for example, may be 25.7 inHg. Thus, a container from location B that is moved to sea level would see an increase in external pressure of 4.2 inHg and a container from location B that is moved to an altitude of 12,000 ft above sea level would see a decrease in external pressure of 6.2 inHg.

The shape, size, number, location, and pattern of the laser drilled, micro-perforations 120 may vary in different embodiments to achieve the desired rate of air transfer depending on various factors such as container shape and size, seal strength, and other factors. In addition to designing the laser micro-perforations 120 to reduce the pressure differential between the internal air pressure in the interior space 30 and the external air pressure on the container, the shape, size, number, location, and pattern of the laser drilled, micro-perforations 120 are also designed to limit the visibility of the perforations to the consumer, limit the risk of insect infestation into the container via the micro-perforations, limit the amount of powder that may escape through the micro-perforations, and not allow water to enter the container through the micro-perforations if the container is submersed in water. Therefore, it is desirable to minimize the number and size of the micro-perforations while still achieving the desired venting performance.

Referring to FIG. 7, in the illustrated embodiment, the sealing membrane 14 includes a first row 122 of multiple laser drilled, micro-perforations 120 extending across the sealing membrane 14 parallel, or generally parallel, to a central longitudinal axis A. The sealing membrane 14 includes a second row 124 of multiple laser drilled, micro-perforations 120 spaced apart from and parallel, or generally parallel, to the first row 122 and on the opposite side of the central longitudinal axis A as the first row 122.

In one embodiment, the first row 122 is a distance $D_1$ from the central longitudinal axis A and the second row 124 is a distance $D_2$ from the central longitudinal axis. In some embodiments, $D_1$ is equal to, or nearly equal to, $D_2$. In other embodiments, however, $D_1$ may be different than $D_2$. In one exemplary embodiment, the distance $D_1$ and/or $D_2$ is in the range of about 0.5 inches to about 1.0 inches, or about 0.65 inches to about 0.85 inches, or about 0.75 inches. In one exemplary embodiment, the first row 122 is closer to the central longitudinal axis A than to the third edge 114 and the second row 124 is closer to the central longitudinal axis A than to the fourth edge 116. Placing the micro-perforations closer to the central longitudinal axis A than the third or fourth edge 114, 116 reduces the risk of distorting the micro-perforations when the sealing membrane 14 is sealed onto the sealing lip 34. In one exemplary embodiment, the width $W_S$ is about 6.25 inches and the first row 122 and/or the second row 124 is about 0.75 inches from the central longitudinal axis A.

In the exemplary embodiment, the first row 122 and the second row 124 include 4-5 individual micro-perforations 120. In other embodiments, however, the first row 122 and second row 124 may include more or less than 4-5 micro-perforations 120. In the exemplary embodiment, the micro-perforations 120 in the first row 122 are spaced apart from each other a distance $D_3$ and the micro-perforations 120 in the second row 124 are spaced apart from each other a distance $D_4$. The spacing of the micro-perforations makes it less likely that a majority of the micro-perforations can become occluded if the packaged contents of the container migrate to one side or the other of the container during transportation or handling.

In the exemplary embodiment, the micro-perforations 120 in the first row 122 are evenly spaced along the first row and the micro-perforations 120 in the second row 124 are evenly spaced along the second row. Thus, each of the first row 122 and the second row 124 of micro-perforations 120 are repeating patterns which aid in the manufacturing process. In one exemplary embodiment, the distance $D_3$ is equal to the distance $D_4$. In one exemplary embodiment, the distance $D_3$ and the distance $D_4$ is in the range of about 1.5 inches to about 1.8 inches, or about 1.65 inches. While in the illustrated exemplary embodiment, the repeating pattern is a continuous row of evenly spaced micro-perforations, in other embodiments, the repeating pattern may be other than evenly spaced micro-perforations, for example, the spacing of the micro-perforations 120 may vary along the rows. Furthermore, in some embodiments, the micro-perforations are not in a repeating pattern.

In the illustrated embodiment, the micro-perforations 120 in the first row 122 are offset along the longitudinal axis A from the nearest micro-perforation 120 in the second row 124 by a distance $D_5$. In other embodiments, however, the micro-perforations 120 in the first row 122 need not be offset from the nearest micro-perforation 120 in the second row 124. In the illustrated embodiment, the distance $D_5$ is less than 0.85 inches, or in the range of about 0.15 inches to about 0.5 inches, or about 0.25 inches. In other embodiments, the distance $D_5$ may be larger than 0.85 inches and smaller than 0.15 inches.

As indicate above, in addition to providing the desired differential pressure relief, the size of the micro-perforations 120 may be selected to limit the visibility of the perforations to the consumer, limit the risk of insect infestation into the container via the micro-perforations, limit the amount of powder that may escape through the openings, and not/or allow water to enter the container through the micro-perforations if the container is submersed in water. It has been found by the inventors, that micro-perforations of less than about 3.937 mils (100 μm) are sufficient to provide the limiting functions described. For example, due to the surface tension of water, water does not breach 3.937 mils (100 μm) micro-perforations. In addition, entomology studies of insects that would be likely candidates to infiltrate packaged granular and powdered food products as described above, indicate that even while immature, those insects would be too large to infiltrate the container through 3.937 mils (100 μm) micro-perforations. Thus, in some exemplary embodiments of the sealing membrane 14, the size of each of the micro-perforations 120 is less than about 3.937 mils (100 μm), is less than about 3.346 mils (85 μm), is in the range of about 0.984 mils (25 μm) to about 3.543 (90 μm), or is in the range of about 2.559 mils (65 μm) to about 3.346 mils (85 μm).

Figure 8:
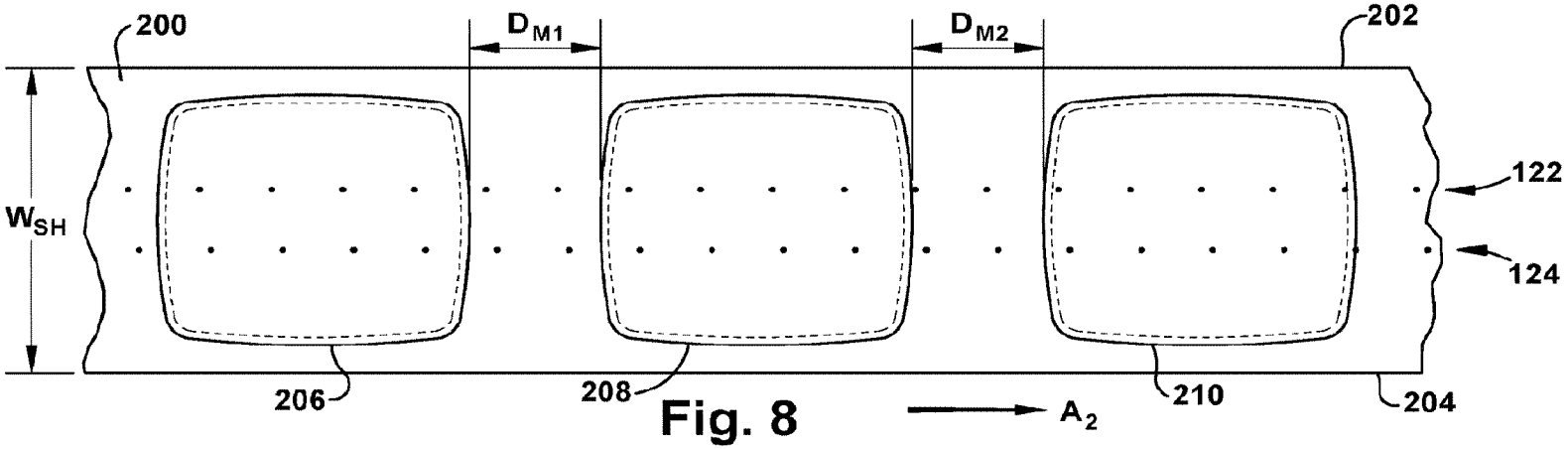
FIG. 8 is a top view of an exemplary sheet of sealing membrane material, showing laser generated micro-perforations.

The sealing membranes 14 may be manufactured in a variety of ways. Referring to FIG. 8, a sheet 200 of sealing membrane material is provided. The sealing membrane material may be, for example, the flexible, five-layer material previously described. The sheet 200 may be a continuous sheet dispensed from a roll or other supply of sealing membrane material (not shown) or the sheet may be a discrete length. The sheet 200 has a first edge 202, a second edge 204, and a width $W_{SH}$. In some embodiments, the width $W_{SH}$ is in the range of about 7 inches to about 8 inches, or about 7.4 inches to about 7.8 inches, or about 7.6 inches.

The sheet 200 of the sealing membrane material moves in a machine direction $A_2$ and is exposed to laser drilling equipment as the sheet moves. The laser drilling equipment may be any suitable laser equipment capable of making consistent, repeatable holes of less than 100 μm in the sealing material. As shown in FIG. 8, the laser drilling equipment creates the first row 122 and the second row 124 of perforations 120 along the sheet 200. The micro-perforations 120 are visibly undetectable and are of a repeatable and consistent size and location on the sheet 200. Mechanically-formed perforations, such as by needling, are inconsistent in size, shape, and quality as compared to laser generated micro-perforations. FIG. 9 illustrates the first and second rows 122, 124 as being continuous along the sheet 200 with the micro-perforations 120 being evenly spaced within each row. In other embodiments, however, the laser drilling equipment may be programmed to make discontinuous rows or other patterns in the sheet 200, such as, but not limited to, diamond pattern, random pattern, or other patterns.

The perforated sheet 200 of the sealing material is positioned over top of a container 10 and a punching die (not shown) punches out the sealing membrane 14 from the sheet 200 of seal material and seals the sealing membrane 14 to the sealing lip 34 of the body 12 via conduction heat sealing. For illustrative purposes, FIG. 8 illustrates a portion of the sheet 200 with three areas outlined that correspond to a first sealing membrane 206, a second sealing membrane 208, and a third sealing membrane 210. The sheet 200, however, may not have outlines of sealing membranes or other indicia printed or otherwise indicated on the sheet 200 prior to punching. In other embodiments, however, an outline or other indicia indicating placement of the sealing membranes may be added to the sheet during manufacturing prior to the punching/sealing operation.

In the exemplary embodiment, the first sealing membrane 206 is separated from the second sealing membrane 208 on the sheet 200 by a distance $D_{M1}$, and the second sealing membrane 208 is separated from the third sealing membrane 210 on the sheet 200 by a distance $D_{M2}$. The distances $DM_1$ and $DM_2$ may be the same or may be different. For example, the distances $DM_1$ and $DM_2$ may be selected to ensure the desired number of micro-perforations 120 are present on each of the sealing membranes 206, 208, 210. In the illustrated embodiment, the distances $DM_1$ and $DM_2$ are in the range of about 2.5 inches to about 3.5 inches, or about 3.0 inches.

Figure 10:
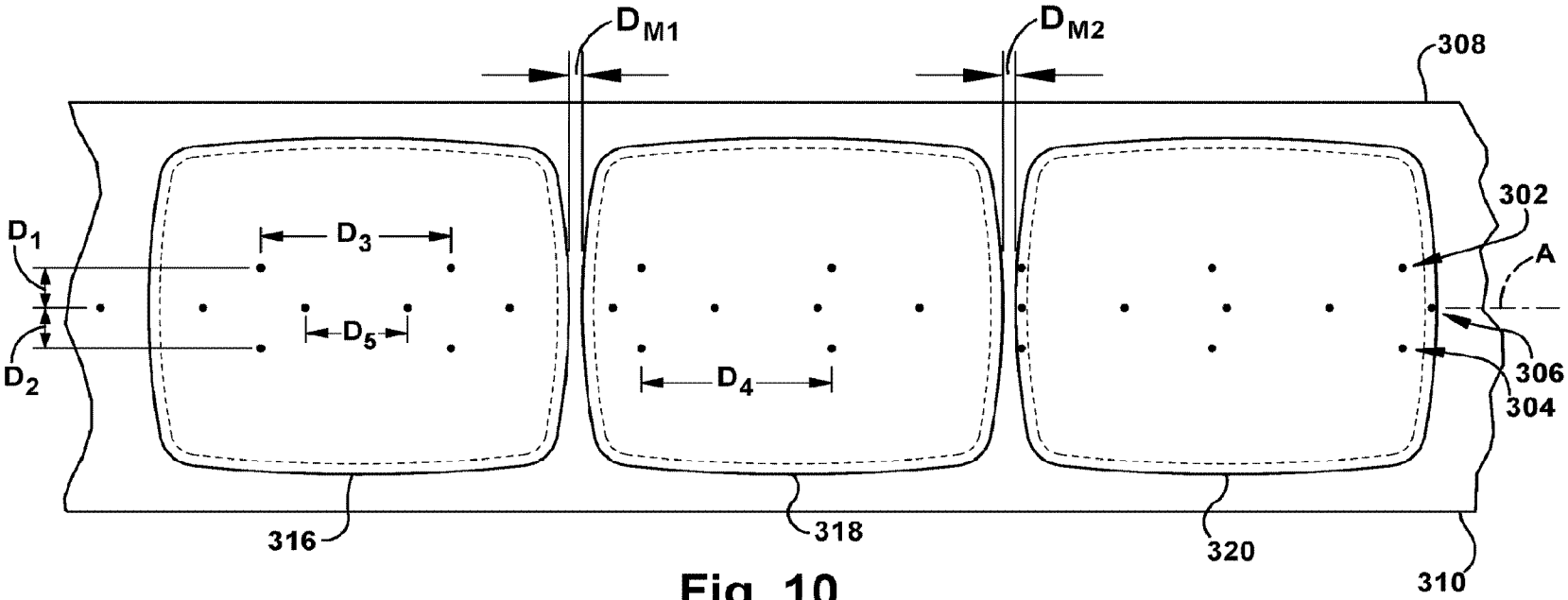
FIG. 10 is a top view of an exemplary sheet of an sealing membrane material, showing laser generated micro-perforations.

FIG. 10 illustrates another exemplary embodiment of a perforated sheet 300 of the sealing membrane material. The sheet 300 may be similar to the sheet 200 of FIG. 8 except that the pattern, spacing, and number of micro-perforations and the spacing of the sealing membranes formed from the sheet differ from the sheet 200. The sheet 300 and the sealing membranes made from the sheet 300 may be similarly dimensioned as the sheet 200 and the sealing membranes made from the sheet 200.

In the illustrated embodiment, the sheet 300 includes a plurality of laser micro-perforations 120. In one embodiment, the size of each of the micro-perforations 120 is less than about 3.937 mils (100 μm), is less than about 3.346 mils (85 μm), is in the range of about 0.984 mils (25 μm) to about 3.543 (90 μm), or is in the range of about 2.559 mils (65 μm) to about 3.346 mils (85 μm).

In the illustrated embodiment, the sheet 300 includes a first row 302 of multiple laser drilled, micro-perforations 120 extending across the sheet 300 parallel or generally parallel to a central longitudinal axis A. The sheet 300 also includes a second row 304 of multiple laser drilled, micro-perforations 120 spaced apart from and parallel, or generally parallel, to the first row 302 and on the opposite side of the central longitudinal axis A as the first row 302. The sheet 300 also includes a third row of 306 of multiple laser drilled, micro-perforations 120 extending lengthwise on the central longitudinal axis A. The sheet includes a first edge 308 and a second edge 310 opposite the first edge 308.

In one embodiment, the first row 302 is a distance $D_1$ from the central longitudinal axis A and the second row 304 is a distance $D_2$ from the central longitudinal axis. In some embodiments, $D_1$ is equal to, or nearly equal to, $D_2$. In other embodiments, however, $D_1$ may be different than $D_2$. In one exemplary embodiment, the distance $D_1$ and/or $D_2$ is in the range of about 0.5 inches to about 1.0 inches, or about 0.65 inches to about 0.85 inches, or about 0.75 inches. In one exemplary embodiment, the first row 302 is closer to the central longitudinal axis A than to the first edge 308 and the second row 304 is closer to the central longitudinal axis A than to the second edge 310.

In the exemplary embodiment, the micro-perforations 120 in the first row 302 are spaced apart from each other a distance $D_3$, the micro-perforations 120 in the second row 304 are spaced apart from each other a distance $D_4$, and the micro-perforations 120 in the third row 306 are spaced apart from each other a distance $D_5$. In the exemplary embodiment, the micro-perforations 120 in the first row 302 are evenly spaced along the first row, the micro-perforations 120 in the second row 304 are evenly spaced along the second row, and the micro-perforations 120 in the third row 306 are evenly spaced along the third row. In other embodiments, however, the spacing of the micro-perforations 120 may vary along the rows. In one exemplary embodiment, the distance $D_3$ is equal to the distance $D_4$ and is greater than the distance $D_5$. In one exemplary embodiment, the distance $D_3$ and the distance $D_4$ is in the range of about 3.0 inches to about 3.5 inches, or about 3.25 inches and the distance $D_5$ is in the range of about 1.5 inches to about 2.0 inches, or about 1.75 inches.

In the illustrated embodiment, the micro-perforations 120 in the first row 302 are generally aligned along the longitudinal axis A from the nearest micro-perforation 120 in the second row 304 and the nearest micro-perforation 120 in the third row 306 is generally offset along the longitudinal axis A from the micro-perforations 120 in the first and second rows 302, 304.

For illustrative purposes, FIG. 10 illustrates a portion of the sheet 300 with three areas outlined that correspond to a first sealing membrane 316, a second sealing membrane 318, and a third sealing membrane 320. The sheet 300, however, may not have outlines of sealing membranes or other indicia printed or otherwise indicated on the sheet 300 prior to punching. In other embodiments, however, an outline or other indicia indicating placement of the sealing membranes may be added to the sheet during manufacturing prior to the punching/sealing operation.

In the exemplary embodiment, the first sealing membrane 316 is separated from the second sealing membrane 318 on the sheet 300 by a distance $D_{M1}$, and the second sealing membrane 318 is separated from the third sealing membrane 320 on the sheet 300 by a distance $D_{M2}$. The distances $DM_1$ and $DM_2$ may be the same or may be different. For example, the distances $DM_1$ and $DM_2$ may be selected to ensure the desired number of micro-perforations 120 are present on each of the sealing membranes 316, 318, 320. In the illustrated embodiment, the distances $DM_1$ and $DM_2$ are in the range of about 0.1 inches to about 0.5 inches, or about 0.25 inches.

In the exemplary embodiment, the first row 302 and the second row 304 include about 2-3 individual micro-perforations 120 per sealing membrane 316, 318, 320 while the third row 306 includes about 4-5 individual micro-perforations 120. Thus, each sealing membrane 316, 318, 320 includes about 8-11 individual micro-perforations 120. In other embodiments, however, the first row 302 and second row 304 may include more or less than 2-3 individual micro-perforations 120 and the third row 306 may include more or less than 4-5 individual micro-perforations 120.

Example

Test containers having the general configuration (Y) as described above were sealed with the five-layer sealing membrane as described above. The number and size of perforations in the sealing membrane were varied among the test containers. A Haug vacuum chamber leak tester was used to simulate ascending elevations in a dry chamber. Each test container was tested separately by placing the sealed container into the Haug tester chamber and monitoring the interior space pressure of the container. The testing started at 1 inHG of vacuum in the tester chamber for one minute and then the chamber vacuum pressure was ramped up at a rate of 0.5 inHg per minute until reaching 10 inHG of vacuum. Peak interior space pressure was recorded at the beginning of each chamber pressure. The seal strength threshold $P_{ST}$ of the seal is known. Table 1 shows average results where more than one test sample was tested for a specific perforation configuration.

TABLE 1

| No. and Size of perforations (number of test sample tested) | Ratio of Interior Space Pressure (inHg) to Seal Strength Threshold Pressure at Exterior Pressure of 6 inHG Vacuum | Ratio of Interior Space Pressure (inHg) to Seal Strength Threshold Pressure at Exterior Pressure of 10 inHG Vacuum |
|---|---|---|
| 4 × 75 μm (5) | 2.08 | 2.36 |
| 6 × 75 μm (1) | 1.14 | — |
| 8 × 75 μm (6) | 0.69 | 0.97 |
| 10 × 75 μm (1) | 0.44 | 0.78 |
| 12 × 75 μm (1) | 0.64 | 0.83 |
| 8 × 90 μm (1) | 0.31 | 0.53 |

The experimental data illustrated, that for the configuration of the container tested, the 8×75 μm samples were able to keep the interior space pressure below the seal strength threshold pressure $P_{ST}$ over the 10 inHG range where pressure was ramped up at a rate of 0.5 inHg per minute, while the 4×75 μm samples and the 6×75 μm samples failed to keep the interior space pressure below the seal strength threshold pressure $P_{ST}$.

This Detailed Description merely describes exemplary embodiments in accordance with the general inventive concepts and is not intends to limit the scope of the invention or the claims in any way. Indeed, the invention as described by the claims is broader than and unlimited by the exemplary embodiments set forth herein, and the terms used in the claims have their full ordinary meaning.

Unless otherwise defined, all technical and scientific terms used herein have the same meaning as commonly understood by one of ordinary skill in the art encompassing the general inventive concepts. The terminology set forth in this detailed description is for describing particular embodiments only and is not intended to be limiting of the general inventive concepts. As used in this detailed description and the appended claims, the singular forms "a," "an," and "the" are intended to include the plural forms as well, unless the context clearly indicates otherwise.

Unless otherwise indicated, all numbers expressing dimensions, pressures, temperature, and so forth as used in the specification and claims are to be understood as being modified in all instances by the term "about." Accordingly, unless otherwise indicated, the numerical properties set forth in the specification and claims are approximations that may vary depending on the suitable properties sought to be obtained in the embodiments of the present invention. Notwithstanding that the numerical ranges and parameters setting forth the broad scope of the general inventive concepts are approximations, the numerical values set forth in the specific examples are reported as precisely as possible. Any numerical values, however, inherently contain certain errors necessarily resulting from error found in their respective measurements.

While various aspects, features and concepts may be expressly identified herein as being inventive or forming part of an invention, such identification is not intended to be exclusive, but rather there may be inventive aspects, concepts and features that are fully described herein without being expressly identified as such or as part of a specific invention. Descriptions of exemplary methods or processes are not limited to inclusion of all steps as being required in all cases, nor is the order that the steps are presented to be construed as required or necessary unless expressly so stated.

The invention claimed is:

1. A sealed container for packaging of granular or powdered product, comprising:

a rigid container body defining an interior space and an upper portion, the upper portion having a sealing lip that defines an opening to the interior space; and a flexible polymer sealing membrane removably attached to the sealing lip to cover the opening, the sealing membrane including a plurality of laser generated micro-perforations formed through the sealing membrane, the size of each of the plurality of laser generated micro-perforations being less than 3.937 mils.

2. The sealed container according to claim 1, wherein the micro-perforations keep the pressure in the interior space below a seal strength threshold pressure when the external pressure acting on the container is decreased from 1 inHG vacuum to 10 inHg vacuum at a rate of 0.5 inHg vacuum per minute.

3. The sealed container according to claim 1, wherein the each of the plurality of laser generated micro-perforations is in the range of about 1.968 mils to about 3.150 mils.

4. The sealed container according to claim 1, the plurality of laser generated micro-perforations is 8-12 micro-perforations.

5. The sealed container according to claim 1, wherein the plurality of micro-perforations include two generally parallel rows of 4-5 evenly-spaced micro-perforations in each row.

6. The sealed container according to claim 5, wherein each of the micro-perforations in each row are spaced apart from one another in the range of about 1.5 inches to about 1.8 inches.

7. The sealed container according to claim 5 wherein each of the micro-perforations in the first row are offset along a longitudinal axis from the nearest micro-perforations in the second row by less than 0.85 inches.

8. The sealed container according to claim 1, wherein the sealing membrane has a total area of less than 50 square inches.

9. The sealed container according to claim 1, wherein the sealing membrane comprises:

a first polymer layer attached to a metalized polyester layer by a first adhesive layer; and a second polymer layer attached to the metalized polyester layer, opposite the first polymer layer, by a second adhesive layer.

10. The sealed container according to claim 9, wherein the second polymer layer includes one or more polymers films from the group of polyethylene terephthalate, polyethylene, and polypropylene.

11. The sealed container according to claim 1 wherein the sealing membrane is attached to the sealing lip by conduction heat sealing.

12. The sealed container according to claim 1 further comprising a snap-on lid attached to the container and covering the sealing membrane.

13. A method of sealing an opening of a container for packaging of granular or powdered product, the method comprising:

providing a sheet of flexible polymer sealing membrane material having a central longitudinal axis;

laser drilling one or more longitudinal rows of micro-perforations into the sheet to form a perforated sheet, each micro-perforation being sized less than 3.937 mils;

positioning the perforated sheet above the container opening;

punching out a sealing membrane from the perforated sheet, wherein the sealing membrane includes 8-12 micro-perforations; and sealing the sealing membrane to the container to cover the opening.

14. The method according to claim 12, wherein the one or more longitudinal rows of micro-perforations is two longitudinal rows each spaced equidistant on opposite sides of the central longitudinal axis.

15. The method according to claim 12, wherein the micro-perforations keep the pressure in an interior space of the container below a seal strength threshold pressure when the external pressure acting on the container is decreased from 1 inHG vacuum to 10 inHg vacuum at a rate of 0.5 inHg vacuum per minute.

16. A seal for a container for packaging of granular or powdered product, comprising:

a flexible polymer sealing membrane including a plurality of laser generated micro-perforations formed through the sealing membrane, the size of each of the plurality of laser generated micro-perforations being less than 3.937 mils, the micro-perforations being arranged in at least two longitudinal rows of micro-perforations, each row being spaced an equidistant from and on opposite sides of a central longitudinal axis of the seal.

17. The seal according to claim 16 wherein the each of the at least two longitudinal rows include 2-5 micro-perforations.

18. The seal according to claim 16 wherein the plurality of micro-perforations is 8-12 micro-perforations.

19. The seal according to claim 16 wherein the sealing membrane comprises:

a first polymer layer attached to a metalized polyester layer by a first adhesive layer; and a second polymer layer attached to the metalized polyester layer, opposite the first polymer layer, by a second adhesive layer.

* * * * *